US007344680B2

(12) United States Patent
Mahler et al.

(10) Patent No.: US 7,344,680 B2
(45) Date of Patent: Mar. 18, 2008

(54) PIPETTE AND PROCESS FOR PRODUCING A PIPETTE

(75) Inventors: Peter Mahler, Kreuzwertheim (DE); Renate Rempt, Wertheim (DE); Peter Prokopp, Wertheim (DE)

(73) Assignee: Brand GmbH + Co KG, Wertheim (DE)

( * ) Notice: Subject to any disclaimer, the term of this patent is extended or adjusted under 35 U.S.C. 154(b) by 576 days.

(21) Appl. No.: 10/345,393

(22) Filed: Jan. 16, 2003

(65) Prior Publication Data

US 2003/0156994 A1 Aug. 21, 2003

(30) Foreign Application Priority Data

Jan. 16, 2002 (DE) ..... 102 01 615
Mar. 16, 2002 (DE) ..... 102 11 794

(51) Int. Cl.
*B01L 3/02* (2006.01)

(52) U.S. Cl. ..... 422/100; 73/864.01; 73/864.14

(58) Field of Classification Search ..... 422/100; 73/864.01, 864.14
See application file for complete search history.

(56) References Cited

U.S. PATENT DOCUMENTS

| | | | | |
|---|---|---|---|---|
| 4,187,724 | A | 2/1980 | Citrin | |
| 4,369,665 | A | 1/1983 | Citrin | |
| 4,863,695 | A | 9/1989 | Fullemann | |
| 4,965,050 | A | 10/1990 | Jessop | |
| 6,532,837 | B1 * | 3/2003 | Magussen et al. | 73/864.14 |
| 6,833,114 | B1 * | 12/2004 | Christen et al. | 422/100 |

FOREIGN PATENT DOCUMENTS

| | | | |
|---|---|---|---|
| DE | 40 36 361 | A1 | 7/1991 |
| DE | 199 17 375 | A1 | 11/2000 |
| DE | 100 13 511 | A1 | 11/2001 |
| DE | 100 56 095 | A1 | 5/2002 |
| EP | 0 148 333 | A1 | 7/1985 |
| EP | 0 293 075 | B1 | 11/1988 |
| EP | 0 454 493 | A2 | 10/1991 |
| EP | 0 760 255 | A1 | 3/1997 |
| EP | 0 837 003 | A1 | 4/1998 |
| WO | 91/16975 | A1 | 11/1991 |
| WO | WO 00/69562 | | 11/2000 |

OTHER PUBLICATIONS

Busak + Shamban "O-Ring 99D/012/011/0401", discussed in the specification.

* cited by examiner

*Primary Examiner*—Jan M. Ludlow
(74) *Attorney, Agent, or Firm*—David S. Safran

(57) ABSTRACT

A pipette has a preferably thermoplastic pipette shaft, for slipping on a likewise preferably thermoplastic pipette tip, has a slip-on section which opens at least slightly conically, and an attachment section which is formed on the lower end of the pipette shaft and onto which the slip-on section of the pipette tip is slipped. A sealing section which is made of an elastically-flexible plastic material which seals well with low withdrawal forces is provided on the attachment section. Furthermore, preferably, a fixing section is formed on the plastic material of the attachment section of the pipette shaft at a location that is axially offset relative to the sealing section. The sealing section of elastic-flexible plastic material is molded directly, retentively, on the preferably thermoplastic material of the pipette shaft.

30 Claims, 3 Drawing Sheets

PIPETTE AND PROCESS FOR PRODUCING A PIPETTE

BACKGROUND OF THE INVENTION

1. Field of the Invention

The subject matter of the invention is a pipette with a pipette shaft which has been produced preferably from thermoplastic onto which a likewise plastic pipette tip is slipped. More specifically, the invention relates to a pipette which has an ejector sleeve which surrounds the pipette shaft and an ejector actuator, the pipette shaft being made for slipping on a likewise plastic pipette tip which has a preferably slightly conically opening slip-on section, the pipette also being provided with an attachment section which is formed on the lower end of the pipette shaft and onto which the slip-on section of the pipette tip is slipped. A sealing section is provided on the attachment section which is formed of an elastically-flexible plastic material which seals well with low withdrawal forces. The ejector sleeve is pushed down axially relative to the pipette shaft by the ejector actuator in order to eject the pipette tip which has been slipped onto the pipette shaft after completing the pipetting process or several pipetting processes, The subject matter of the invention is also a process for producing such a pipette by which the sealing section of elastically-flexible plastic material is directly retentively molded onto the plastic of the pipette shaft.

2. Description of Related Art

Both individual pipettes and also multichannel pipettes or larger pipetting devices are subject to the problem that the pipette tip must be slipped on the pipette shaft, forming a seal but, at the same time, the tip must be able to be pushed off from the pipette shaft by means of mechanical ejection with as little expenditure of force as possible. High withdrawal forces of the pipette tip require a high expenditure of force when the ejector sleeve is actuated. Therefore, providing transmission devices between the ejector actuation and the ejector sleeve is already known; but, this increases the actuation paths.

The problem of withdrawal forces is especially great in pipettes known to date in which the pipette shaft is produced from a relatively hard, wear-resistant plastic and the tip is produced from somewhat less hard, deformable plastic, especially polypropylene. The attachment section of pipette shaft can be easily damaged. The conically matched surfaces then become loose. The user tries to compensate for this by especially vigorous pushing of the pipette tip onto the attachment section of the pipette shaft.

In the prior art, the attempt has already been made to circumvent the existing, aforementioned problem by producing an actively deformable seal between the slip-on section of the pipette tip and the attachment section (International Patent Application Publication WO 91/16975). To do this, an O-ring or some other elastically deformable material is used. However, here, there is the problem of cleaning and the structurally comparatively great effort for the actuating mechanism. Moreover, the existence of gaps is a problem. Overpipetted sample liquid can be carried over and a following specimen can be contaminated.

Nevertheless, the above explained concept has been developed differently. The pipette which is known in this respect and which forms the starting point for the teaching of this patent application (U.S. Pat. No. 4,863,695) has a separate sealing cone of effectively sealing, elastically-flexible plastic material which is slipped onto the lower end of the pipette shaft in a recess and ensures the sealing of the attachment section to the slip-on section. Axially above this sealing section which is formed in a separate molding, there is a fixing section which is formed on the material of the pipette shaft itself with a conical contour which corresponds to the conical contour of the slip-on section of the pipette tip which has been slipped on there at the top. On the pipette shaft, there is a peripheral ring flange as the stop for pushing on the pipette tip.

The above explained pipette known from the prior art has the advantage that this construction of the pipette shaft enables the use of different pipette tips from different manufacturers. The pipette shaft is relatively insensitive to tolerances both with respect to the pipette tips used and also with respect to the accuracy of the slip-on process. In any case, the separate formation of the sealing section is a problem in the slipped-on sealing element with respect to gap formation, cleaning possibilities and danger of contamination in the same way as in the above explained prior art.

It should be stated that the above-explained pipette underlying the present invention is provided with an ejector sleeve and ejector actuator for the pipette tip. The initially explained problem of withdrawal forces when ejecting the pipette tip is therefore present there. Secure seating and good sealing of the pipette tip on the pipette shaft, on the one hand, and low withdrawal forces when the pipette tip is ejected, on the other hand, are inherently contradictory requirements which are to be brought into agreement in this prior art by the use of a separate sealing cone.

Another problem in using different generic pipette tips of different manufacturers in conjunction with the known ejector sleeve is that the effective axial length of the slip-on section of the pipette tip is different for the different pipette tips. The effective axial length designated in this way is the length with which the slip-on section of the pipette tip sits on the attachment section of the pipette shaft. The effective axial length of the slip-on section therefore determines what axial distance the end of the pipette tip has from the front edge of the ejector sleeve.

In the prior art, it has already been recognized that there are cases in which the pipette ejector sleeve which is actuated by the ejector only just touches the edge of the pipette tip, or in any case, the pipette tip can no longer be effectively ejected. To solve this problem, the use of an annular adapter has been proposed (U.S. Pat. No. 4,965,050). With such an adapter, the distance from the ejector sleeve and the edge of the slip-on section of the pipette tip can be bridged with an exact fit.

SUMMARY OF THE INVENTION

The primary object of the present invention is to embody and develop a pipette of the type described initially such that a pipette shaft that is insensitive to tolerance is achieved, withdrawal forces are low when the pipette tip is ejected, and moreover, the above described problems with cleaning and the danger of contamination are eliminated.

The aforementioned object is achieved in the pipette of the type described initially by the sealing section which is made of an elastic-flexible plastic material which seals well being retentively molded directly to the plastic of the pipette shaft. In accordance with the invention, the sealing section is not made of a separate part, but is retentively molded directly on the thermoplastic of the pipette shaft. This has the advantage that the sealing section is captively held and is not displaced when the pipette tip is slipped on. In this way, a spongy stop feeling for the user can be avoided. Nor is a gap formed by the displacement of the sealing section, so that there is no contamination. A second sealing site between the recess of the pipette shaft and the sealing section is unnecessary. The boundary layer is sealed and neither dirt nor liquid can penetrate.

In particular, material-bonded molding is recommended in which, therefore, a material composite results on the boundary layer of the meeting plastic materials.

It is especially advantageous if the approach of the invention is implemented by the pipette shaft with the sealing section being made, cost-efficiently, without installation effort as a dual component plastic, injection molded part.

The subject matter of the invention is also a process for producing a pipette with the features of the invention, i.e., wherein the sealing section of elastically-flexible plastic material is directly retentively molded onto the plastic of the pipette shaft.

The invention is explained in detail below with reference to the accompanying drawings which show a preferred embodiment of the invention.

DETAILED DESCRIPTION OF THE INVENTION

Figure 1:
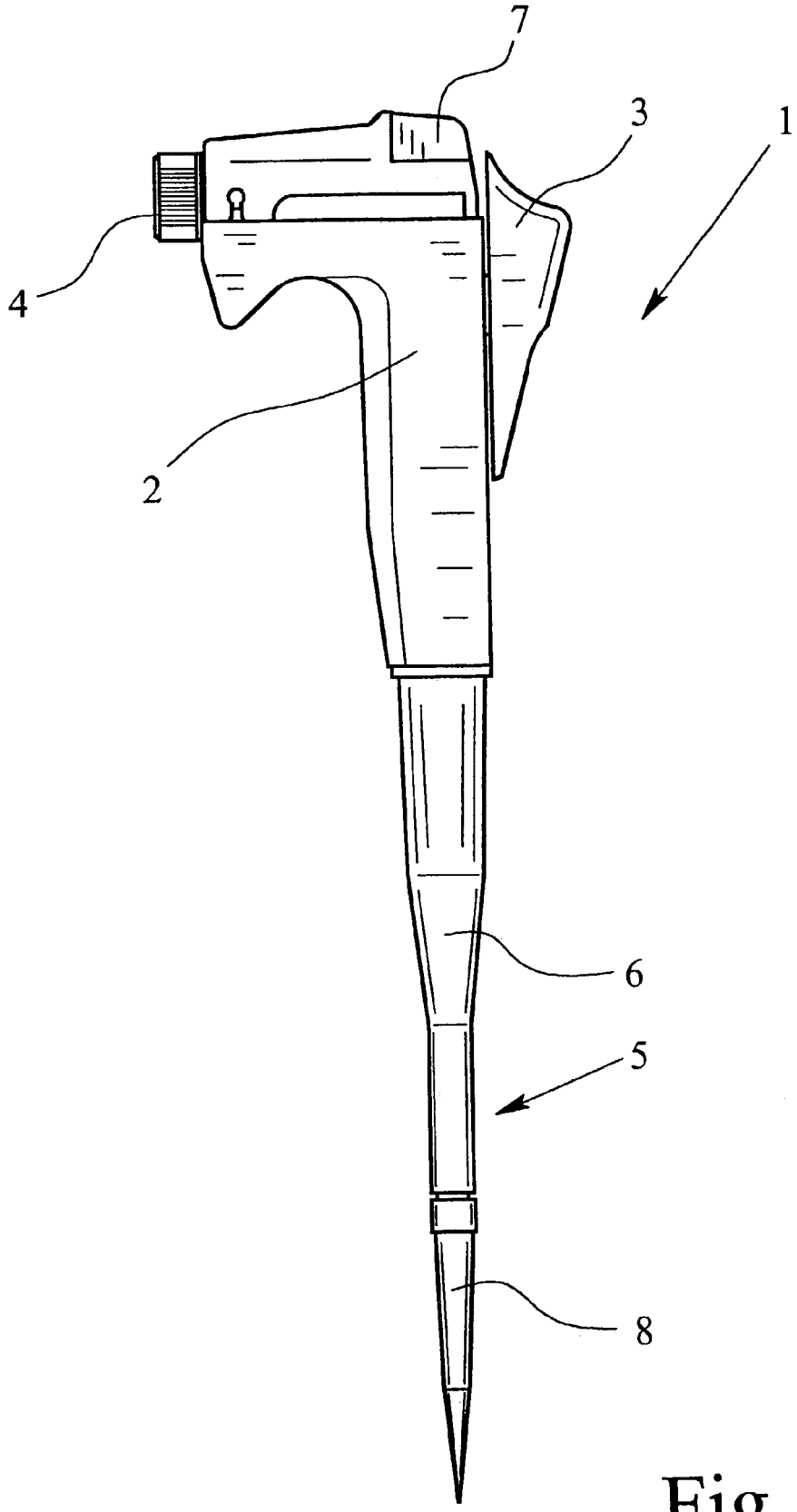
FIG. 1 is an elevational view of an embodiment of the pipette in accordance with the invention.

FIG. 1 a single channel pipette 1. As has already been explained in the general part of the specification, the teaching of this invention is not limited to a single channel pipette, but rather it can, likewise, be used for multi-channel pipettes (compare German Patent Application DE 100 13 511 A1) and also for mechanical pipetting means. The teaching of the invention is the coupling of the pipette tip to the pipette shaft of a pipette.

German Patent Application DE 100 13 511 A1 relates to structural approaches to interchangeability of the pipette shaft in a multi-channel pipetting means. These structural approaches can also be used in a multi-channel pipette which is made according to the teaching of this application.

FIG. 1 shows the pipette 1 with a handle 2, a manual actuation button which constitutes the actuator 3 of the pipette, an adjustment element 4 for adjusting the volume to be pipetted and/or for calibration of the pipette 1, and a pipette shaft 5. An ejector sleeve 6 is located on the bottom end the pipette shaft 5 (which is hidden in FIG. 1). To eject the pipette tip 8 (which has been slipped onto the pipette shaft 5 from below) after completing the pipetting process or several desired pipetting processes, the ejector sleeve 6 is axially pushed down (in FIG. 1) by the ejector actuator 7 which is, likewise, made as a push-button.

The invention seeks to make slipping of the pipette tip 8 onto the pipette shaft 5, forming a reliable seal, and ejection of the pipette tip 8 from the pipette shaft 5 by actuating the ejector sleeve 6, as easy as possible. All this will be easy to carry out not only when OEM pipette tips (OEM=original equipment manufacture) which are made to fit the pipette 1 are used, but also when generic pipette tips 8 are mounted on the pipette shaft 5. Likewise, the invention ensures that the pipette tip 8 can be easily and quickly attached to the pipette shaft 5, with a certain tolerance insensitivity when the pipette shaft 5 is attached slightly obliquely.

In the enlarged sectional view of FIG. 2, the lower end of the pipette shaft 5 can be seen to have an axial flow channel 9 in the middle for carrying out the pipetting process, and a pipette tip 8 slipped onto the pipette shaft 5 from below. The pipette shaft 5 is surrounded by the ejector sleeve 6.

Therefore, the invention is a pipette 1 with a preferably thermoplastic pipette shaft 5 for receiving a likewise preferably thermoplastic pipette tip 8. The pipette tip 8 has slip-on section 10 which opens at least slightly conically, and an attachment section 11 is formed on the lower end of the pipette shaft 5 onto which the slip-on section 10 of the pipette tip 8 is slipped. A sealing section 12 which is made of an elastically-flexible plastic material and which seals well with low withdrawal forces is provided on the attachment section 11. In this embodiment, it is additionally provided that a fixing section 13 is formed on the plastic material of the pipette shaft 5 and is axially offset relative to the sealing section 12. The fixing section is explained in detail below.

It is significant that the sealing section 12 of elastic-flexible plastic material is retentively molded directly to the plastic of the pipette shaft 5. In this embodiment, this molding is performed such that the sealing section 12 is molded to the pipette shaft 5 with material bonding.

Basically, another attachment possibility which leads to direct tight adhesion to the pipette shaft 5 can also be implemented. For example, a spraying-on process is possible which is combined, optionally, with a subsequent shrinking process. Also, thermo-compression or ultrasonic bonding yields a directly retentive arrangement, by the use of a reaction cement or the like.

The preferred embodiment shown is characterized especially by the pipette shaft 5 with the sealing section 12 being made as a dual component plastic, injection molded part, one component being the material of the pipette shaft 5 and the other component being the material of the sealing section 12. The elastic and flexible plastic material on which or in which the sealing section 12 is made can be implemented especially feasibly in the dual component plastic-injection molding. The joining of the materials is especially intimate, and a perfect material-bonded connection of the plastic materials can be produced.

The preferred embodiment shown, in particular, calls for the plastic of the pipette shaft 5 to be polypropylene which is preferably talc-reinforced. In particular, it is appropriate for this material selection that the plastic material of the sealing section 12 is a mixture of polypropylene/ethylene-propylene-diene-terpolymer (PP/EPDM blend). A material choice which is likewise compatible with polypropylene is, for example, also a thermoplastic elastomer (TPE).

There are various possibilities for equipping the pipette shaft 5 of the pipette 1 with the sealing section 12. First, it is possible to deposit the sealing section 12 by simple application to the plastic material of the pipette shaft 5. The forces directed in the axial direction when the pipette tip 8 is slipped on and ejected can lead to problems here. Accordingly, it is especially expedient that, in this embodiment, the pipette shaft 5, in the area of the sealing section 12, has a peripheral, annular groove-like recess 14 of a certain axial extension and that the sealing section 12 is molded on in the recess 14. This recess 14 is apparent, at the left, in the partial section of FIG. 2. The sealing section 12 is made in the recess 14 during dual component plastic-injection molding process.

The sealing section 12 can be extended into the upper area to under the ejector sleeve 6. Thus, the transition from the sealing section 12 to the surface of the pipette shaft 5 is not critical and need not be made flush. For example, it could be provided there that the pipette shaft 5 projects slightly farther radially to the outside, forms a ring-like shoulder and represents a guide for the ejector sleeve 6.

In any case, this embodiment of the pipette 1 in accordance with the invention can be optimally sealed, the sealing section 12/pipette shaft 5 connecting site is free of gaps on all sides in the area of the recess 14 and is connected so as to bee completely tight. Sealing to the slip-on section 10 of the pipette tip 8 is implemented with an elastic-flexible plastic material and optimally matched to operation.

It has already been pointed out above that the requirement for a secure seat and good seal of the pipette tip 8 on the pipette shaft 5, on the one hand, contradicts the requirement for low withdrawal forces during ejection of the pipette tip 8 to a certain extent, on the other hand. Accordingly, contradictory requirements which must be brought into agreement are imposed on the plastic material of the sealing section 12. The plastic material of the sealing section 12 must be chosen such that the deformability and the wear resistance are in a balanced relationship. By increasing the pliability of the plastic material, the abrasive surface wear which then becomes especially strong when the plastic material of the sealing section 12, for example, the thermoplastic elastomer, is strongly upset, can be counteracted.

In addition, the plastic material of the sealing section 12, for its part, can be again provided with a low-wear and/or low-friction protective layer. For graphic reasons, this additional protective layer is not shown in FIG. 2 of the drawings; however, it can be identified at 12' in FIG. 3. It can be provided that the plastic material of the sealing section 12 is provided, at least in the main contact area, with this protective layer 12' which, for its part, is retentively molded directly on the plastic material of the sealing section 12, especially by material bonding. Therefore, as a result, the elastomer material core of the sealing section 12 which provides the necessary and desired deformability of the sealing section 12 is then coated with a thin, flexible, sleeve-like layer of preferably thermoplastic material which yields the desired wear resistance. One example is a coating of PTFE (polytetrafluoroethylene). For example, an attempt can be made to apply PTFE in powder form in a suspension with oil to the core of the sealing section 12. In this way, a fine PTFE protective layer can be produced by extremely fine PTFE powder being distributed in a dispersed manner electrostatically on the core of the sealing section 12 and this layer is then be thermally melted on to form a closed coating. One interesting alternative to PTFE is, for example, FEP (a copolymer that is formed of hexafluoropropylene and tetrafluoretheylene).

The production of corresponding protective layers is known from the area of production of coated O-rings (brochure from Busak+Shamban, "O-Ringe" 99D/011/0401). For example, a silicone grease is possible as a protective layer, for example, in a dispersion process, as one version of the protective layer.

In conjunction with the fact that the intention is to make the seal optimally matched to operation, it can be further recommended that at least one ring-like area 15 of a larger diameter be formed on the sealing section 12. In this way, a defined ring-like seal is formed at this location. In this version, a concentrated line contact area is formed in which the above explained considerations for a low-wear and/or low-friction protective layer 12' acquire special importance. In fact, this protective layer may be provided only in the ring-like area 15 of larger diameter.

For the configuration of the ring-like area 15 of larger diameter, there are also, of course, again, special versions. For example, two successive rings, or specially shaped rings, as in U.S. Pat. No. 4,863,695, or lip-shaped annular configurations as in published German Patent Application DE 100 13 511 A1 can be implemented in the area of the tip seal if this has been established as feasible in terms of application technology.

Two sections which have been formed axially in succession on the pipette shaft 5 and which are used for sealing and fixing are feasible. They make it possible to align the pipette tip 8 on the pipette shaft 5 and to stably attach the pipette tip 8 on the pipette shaft 5 even with transverse forces without this frictional connection being loosened. This embodiment shows that a fixing section 13, which is made of the plastic material of the pipette shaft 5, is formed on the attachment section 11, axially offset relative to the sealing section 12. Here, it is feasible that the fixing section 13 is formed on the bottom end of the pipette shaft 5 and the sealing section 12 is positioned with an axial distance from the lower end of the pipette shaft 5. The fixing section 13 is used, at the same time, as a stop in the inner cone of the slip-on section 10 of pipette tip 8, which cone becomes more blunt.

Figure 2:
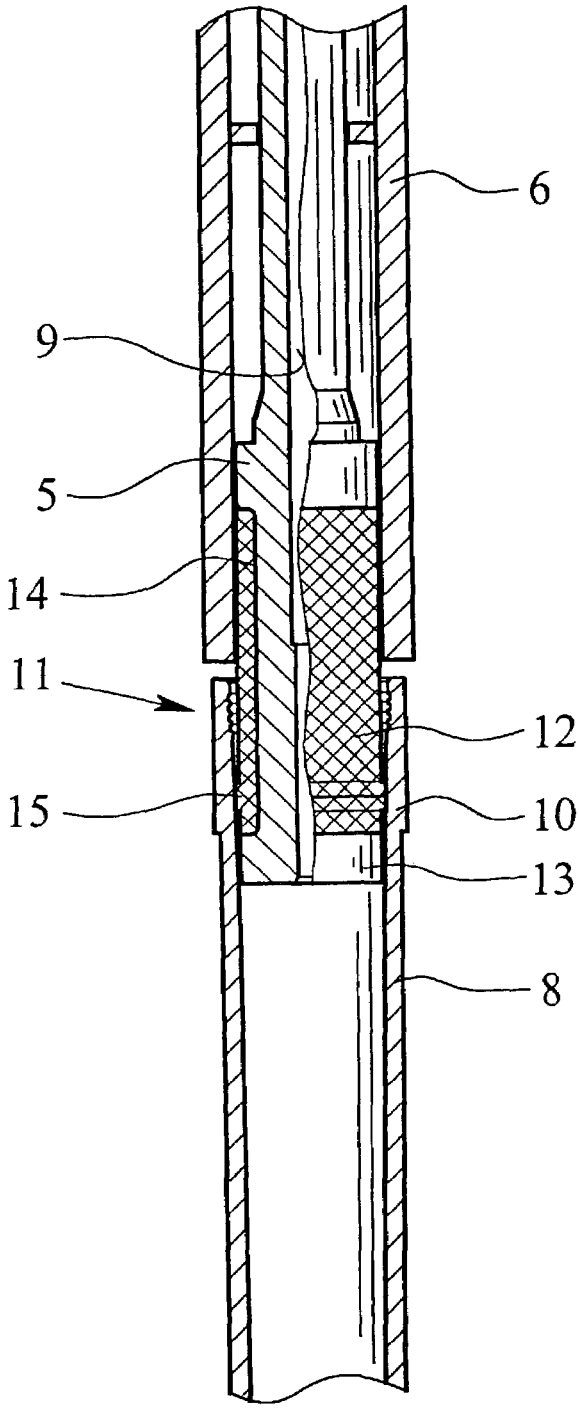
FIG. 2 is a sectional view of the area of the lower end of the pipette shaft of the pipette from FIG. 1.

The preferred embodiment shown in FIG. 2 further shows that the attachment section 11 of the pipette shaft 5 has a cylindrical outside contour which is interrupted by the ring-like area 15 of the sealing section 12 or has a less strongly conical contour than the slip-on section 10 of the pipette tip 8 so that the lower edge of the pipette shaft 5 forms the fixing section 13.

Figure 3:
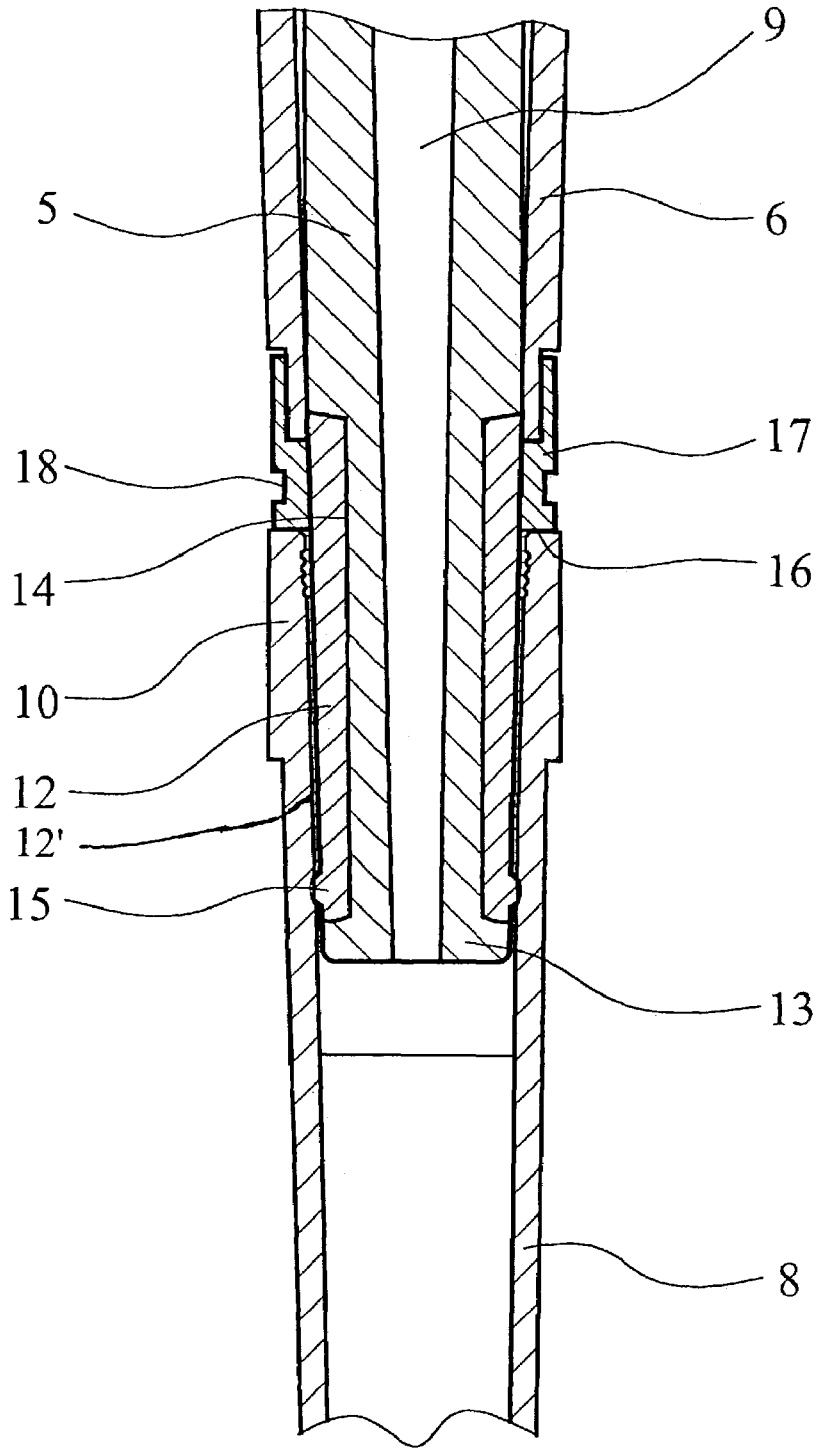
FIG. 3 is a sectional view similar to that of FIG. 2, but with a pipette shaft having an additional spacer element for a certain pipette tip.

FIG. 3 shows another preferred embodiment of a pipette 1. Here, what matters first of all is that there is a peripheral ring flange 16 at a distance from the end of the pipette shaft 5, the peripheral ring flange 16 being used, optionally, as a slip-on stop for the slip-on section 10 of pipette tip 8. Such a ring flange 16 is also recognizable on the lower end of the ejector sleeve 6 in FIG. 1. The lower edge of the ejector sleeve 6 forms this ring flange 16 which ultimately exercises the ejector function.

The peripheral ring flange is provided on the lower end of the ejector sleeve at a distance form an end of the pipette shaft, the ring flange being usable as a slip-on stop for the slip-on section of the pipette tip. At least one of a rest position of the ejector sleeve on the pipette shaft and an actuation path of the ejector sleeve is axially adjustable so that pipette tips of different axial lengths of the slip-on section can be used.

FIG. 3 shows a modification which again clearly expands the range of application of the claimed pipette 1. Specifically, it is provided that, on the lower end of the ejector sleeve 6, there is interchangeably located a spacer element 17 of a certain axial length which forms the ring flange 16 so that pipette tips 8 can be used having different effective axial lengths of the slip-on section 10 together with the pipette shaft 5. This embodiment shows that, here, the spacer element 17 is made as a type of plastic spacer sleeve. This spacer element 17 is not only simply slipped onto the pipette shaft 5, but it is also attached to the ejector sleeve 6, specifically slipped onto it. Therefore, the spacer element 17 forms a unit with the ejector sleeve 6 which can be moved overall by means of the ejector actuation 7.

It is obvious that this version is used to implement different distances between the lower edge of the ejector sleeve 6 and the upper edge of the slip-on section 10 of a slipped-on pipette tip 8. Thus, different pipette tips 8 can be used. Therefore, it is expedient that there can be several spacer elements 17 of different axial length on the ejector sleeve 6, especially that they can be attached to it.

In order to change or remove the spacer element 17, in the latter case, then the lower edge of the ejector sleeve 6 itself would become the ring flange 16; this embodiment furthermore shows that the spacer element 17 on the outside is provided with a manipulation shape 18, especially in the form of an annular recess or ring groove. Therefore, a manipulation tool, a removal or slip-on tool, can engage the manipulation shape 18 in order remove or slip on the spacer element 17.

In an especially expedient production process of the dual component plastic, injection molding in which the sealing section is formed jointly with the pipette shaft, there are different possible procedures.

In the classical dual component plastic, injection molding technique, different materials which are intimately joined in the injection mold, but which are chemically compatible with one another, are injected into the injection mold. In this way, at the same time, areas of different hardness are formed in the injection mold. This is the process which is mainly provided in this case as well.

When using materials other than those described above, however, it is also possible to proceed such that, in an injection mold, first the areas of the pipette shaft itself are formed at the same time and the forming volumes of the sealing section are closed, and then after sufficient cooling of the areas of the pipette shaft which have been formed in this way, the forming volumes of the other areas are opened and the plastic material to be used is injected and molded on in this way.

Another alternative which is likewise expedient in terms of production technology lies in working with two injection molds, forming the pipette shaft first in the first injection mold and then, after sufficient cooling, placing the semifinished molded "pipette shaft" in a second injection mold and molding on the sealing section in it.

The latter two process techniques make it possible to work with a greater variety of different materials for the pipette shaft, on the one hand, and the sealing section, on the other hand, which must meet as the remaining criterion simply sufficient adhesion of the sealing section formed in the second stage to the surface of the pipette shaft formed in the first stage. A material-bonded connection as extensive as in the classical dual component injection molding process is only achieved with difficulty, though. The use of one or the other process therefore presupposes a corresponding analysis of the withdrawal forces and sealing forces which occur in practice on the finished part.

The applied dual component plastic-injection molding process, as the production process at this location of a pipette, develops various effects which results in an especially expedient and an unforeseeably synergistic result.

The formation of a protective layer 12' on the plastic material of the sealing section 12 has been explained above in particular in conjunction with the explanation of the formation of the seal on the slip-on section 10 of the pipette tip 8. The production processes cited there for such a low-friction protective layer can also be used in this case.

What is claimed is:

1. Pipette, comprising:

a pipette shaft made of a plastic material, the pipette shaft having an attachment section formed on a lower end thereof which is adapted for slip-on reception of a plastic pipette tip having a slip-on section with an opening for slip-on attachment to said attachment section, an ejector sleeve which surrounds the pipette shaft, and an ejector actuator arranged to axially push the ejector sleeve down relative to the pipette shaft in order to eject a pipette tip, which has been slipped onto the pipette shaft from below, after completing at least one pipetting process;

wherein a sealing section made of an elastically-flexible plastic material is joined to the attachment section of the pipette shaft by having been retentively molded directly to the plastic material of the pipette shaft; and, wherein an upper area of the sealing section is permanently located under the ejector sleeve such that a transition from the sealing section to the pipette shaft is always covered by the ejector sleeve.

2. Pipette as claimed in claim 1, wherein the pipette shaft in an area of the sealing section has a peripheral, annular groove-shaped recess, and wherein the sealing section is molded onto the pipette shaft so as to extend into said recess.

3. Pipette as claimed in claim 2, wherein the plastic material of the sealing section ends flush with edges of the recess.

4. Pipette as claimed in claim 1, wherein the plastic material of the sealing section, at least in a primary contact area, is provided with a protective layer having at least one of low-wear and low-friction properties and which has been molded directly to the plastic material of the sealing section.

5. Pipette as claimed in claim 1, wherein the sealing section has a body portion on which at least one annular area of larger diameter is formed.

6. Pipette as claimed in claim 1, wherein a fixing section is formed on the attachment section at a location that is axially offset relative to the sealing section at a bottom end of the pipette shaft and wherein the sealing section is positioned at an axial distance from the bottom end of the pipette shaft.

7. Pipette as claimed in claim 6, wherein the attachment section of the pipette shaft has an approximately cylindrical outside contour so that a lower edge of the bottom end of the pipette shaft forms the fixing section.

8. Pipette as claimed in claim 1, wherein a lower end of the ejector sleeve forms a peripheral ring flange on the pipette shaft at a distance from an end of the pipette shaft, said ring flange being usable as a slip-on stop for the slip-on section of the pipette tip, and wherein a spacer element is provided which is mountable on the lower end of the ejector sleeve for adapting the pipette for use with a pipette tip having a slip-on section of a different effective axial length together with the pipette shaft.

9. Pipette as claimed in claim 8, wherein the spacer element is attachable to the ejector sleeve by being slipped thereon.

10. Pipette as claimed in claim 9, wherein a plurality of spacer elements are provided, each of which is of a different axial length, said spacer elements being interchangeably mountable on the lower end of the ejector sleeve which forms the ring flange for adapting the pipette for use with pipette tips having a slip-on sections of a number of different effective axial lengths together with the pipette shaft.

11. Pipette as claimed in claim 8, wherein the lower end of the ejector sleeve, itself, without the spacer element forms the ring flange for a pipette tip having a slip-on section with a given effective axial length.

12. Pipette as claimed in claim 8, wherein a manipulation shape is provided on the outside of the spacer element in the form of an annular recess or annular groove.

13. Pipette as claimed in claim 1, wherein a peripheral ring flange is provided on the lower end of the ejector sleeve at a distance from an end of the pipette shaft, said ring flange being usable as a slip-on stop for the slip-on section of the pipette tip, and wherein at least one of a rest position of the ejector sleeve on the pipette shaft and an actuation path of the ejector sleeve is axially adjustable so that pipette tips of different effective axial lengths of the slip-on section thereof together with the pipette shaft can be used.

14. Pipette as claimed in claim 1, wherein the plastic material of the pipette shaft is a talc-reinforced polypropylene.

15. Pipette as claimed in claim 14, wherein the plastic material of the sealing section is a mixture of polypropylene/ethylene-propylene-diene-terpolymer (PP/EPDM blend).

16. Pipette as claimed in claim 14, wherein the plastic material of the sealing section is a thermoplastic elastomer (TPE).

17. Pipette as claimed in claim 1, comprising:

wherein the pipette shaft with the sealing section is a dual component plastic-injection molded part, a first component of which is the plastic material of the pipette shaft and a second component of which is the plastic material of the sealing section;

wherein a peripheral, annular, groove-shaped recess is located in the pipette shaft in proximity to but spaced from a free end of the pipette shaft, said recess having a bottom wall and side walls, a fixing section extending from one of said side walls toward said free end of the pipette shaft;

wherein the plastic material of the sealing section is fixed in the recess, completely filling the recess without gaps; and wherein the attachment section of the pipette shaft has an approximately cylindrical outside contour so that a lower edge of the bottom end of the pipette shaft forms the fixing section.

18. Pipette as claimed in claim 17, wherein the sealing section is molded on the pipette shaft in a manner resulting in a material bond having been formed between the plastic material of the pipette shaft and the elastically-flexible plastic material of the sealing section.

19. Pipette as claimed in claim 17, wherein the plastic material of the sealing section, at least in a primary contact area, is provided with a protective layer having at least one of low-wear and low-friction properties and which has been molded directly to the plastic material of the sealing section.

20. Pipette as claimed in claim 17, wherein the sealing section has a body portion on which at least one annular area of larger diameter is formed.

21. Pipette as claimed in claim 17, wherein a lower end of the ejector sleeve forms a peripheral ring flange on the pipette shaft at a distance from an end of the pipette shaft, said ring flange being usable as a slip-on stop for the slip-on section of the pipette tip, and wherein a spacer element is provided which is mountable on the lower end of the ejector sleeve for adapting the pipette for use with a pipette tip having a slip-on section of a different effective axial length together with the pipette shaft.

22. Pipette as claimed in claim 21, wherein the spacer element is attachable to the ejector sleeve by being slipped thereon.

23. Pipette as claimed in claim 22, wherein a plurality of spacer elements are provided, each of which is of a different axial length, said spacer elements being interchangeably mountable on the lower end of the ejector sleeve which forms the ring flange for adapting the pipette for use with pipette tips having a slip-on sections of a number of different effective axial lengths together with the pipette shaft.

24. Pipette as claimed in claim 21, wherein the lower end of the ejector sleeve, itself, without the spacer element forms the ring flange for a pipette tip having a slip-on section with a given effective axial length.

25. Pipette as claimed in claim 21, wherein a manipulation shape is provided on the outside of the spacer element in the form of an annular recess or annular groove.

26. Pipette as claimed in claim 17, wherein a peripheral ring flange is provided on the lower end of the ejector sleeve at a distance from an end of the pipette shaft, said ring flange being usable as a slip-on stop for the slip-on section of the pipette tip, and wherein at least one of a rest position of the ejector sleeve on the pipette shaft and an actuation path of the ejector sleeve is axially adjustable so that pipette tips of different effective axial lengths of the slip-on section thereof together with the pipette shaft can be used.

27. Pipette as claimed in claim 17, wherein the plastic material of the pipette shaft is a talc-reinforced polypropylene.

28. Pipette as claimed in claim 27, wherein the plastic material of the sealing section is a mixture of polypropylene/ethylene-propylene-diene-terpolymer (PP/EPDM blend).

29. Pipette as claimed in claim 27, wherein the plastic material of the sealing section is a thermoplastic elastomer (TPE).

30. Pipette as claimed in claim 17, wherein a spacer element is attachable to the ejector sleeve by being slipped thereon; and wherein a plurality of spacer elements are provided, each of which is of a different axial length, said plurality of spacer elements being individually interchangeably mountable on the lower end of the ejector sleeve which forms the ring flange for adapting the pipette for use with pipette tips having a slip-on sections of a number of different effective axial lengths together with the pipette shaft.

* * * * *